US012043475B2

(12) United States Patent
Schouten

(10) Patent No.: US 12,043,475 B2
(45) Date of Patent: Jul. 23, 2024

(54) COLLAPSIBLE SHIPPING CONTAINER

(71) Applicant: Jan Paul Schouten, Toronto (CA)

(72) Inventor: Jan Paul Schouten, Toronto (CA)

( * ) Notice: Subject to any disclaimer, the term of this patent is extended or adjusted under 35 U.S.C. 154(b) by 244 days.

(21) Appl. No.: 17/595,040

(22) PCT Filed: May 25, 2020

(86) PCT No.: PCT/CA2020/050707
§ 371 (c)(1),
(2) Date: Nov. 5, 2021

(87) PCT Pub. No.: WO2020/237362
PCT Pub. Date: Dec. 3, 2020

(65) Prior Publication Data

US 2022/0242660 A1 Aug. 4, 2022

Related U.S. Application Data

(60) Provisional application No. 62/853,355, filed on May 28, 2019.

(51) Int. Cl.
*B65D 88/52* (2006.01)

(52) U.S. Cl.
CPC ..... *B65D 88/522* (2013.01)

(58) Field of Classification Search
CPC .... B65D 88/522; B65D 88/52; B65D 88/121; B65D 11/18; B65D 21/086; B65D 90/008
USPC ..... 220/1.5, 6, 666, 4.28, 4.29, 9.2, 810
See application file for complete search history.

(56) References Cited

U.S. PATENT DOCUMENTS 3,398,850 A * 8/1968 Kennard ..... E04B 1/3445 217/14
3,799,384 A * 3/1974 Hurkamp ..... B65D 88/522 220/6
4,506,798 A * 3/1985 Goutille ..... B65D 88/528 220/4.28
6,811,048 B2 * 11/2004 Lau ..... B65D 88/12 220/4.28

FOREIGN PATENT DOCUMENTS

WO WO2008104193 * 9/2008 ..... B65D 88/52

* cited by examiner

*Primary Examiner* — John K Fristoe, Jr.
*Assistant Examiner* — Elizabeth J Volz
(74) *Attorney, Agent, or Firm* — Aird & McBurney LP

(57) ABSTRACT

A collapsible intermodal shipping container is provided. The container includes door frame posts and sidewalls that are each segmented into long and short portions that enable the door frames and sidewalls to articulate. When collapsed, the long portions of the door frame posts lie folded at right angles to the short portions of the door frame posts and the long portions of the sidewalls lie folded at right angles to the short portions of the sidewalls.

18 Claims, 11 Drawing Sheets

COLLAPSIBLE SHIPPING CONTAINER

CROSS-REFERENCE TO RELATED APPLICATIONS

This application claims the benefit of U.S. Provisional application No. 62/853,355 filed May 28, 2019, the content of which is incorporated herein by reference in its entirety.

FIELD

This disclosure relates generally to shipping containers, particularly intermodal containers.

BACKGROUND OF THE DISCLOSURE

Collapsible shipping containers are known. One example is disclosed in U.S. Pat. No. 3,799,384 to Hurkamp. Such containers are, however, not in widespread use, particularly not in intermodal transport where such containers are typically stacked on top of another and can be subject to significant loads. This may be because prior art containers are either not durable or impose safety risks to the workers charged with collapsing and expanding such containers. It would be advantageous to provide a collapsible shipping container that mitigates one or more of these problems and/or other problems.

SUMMARY OF THE DISCLOSURE

In an aspect a collapsible shipping container is provided. The collapsible shipping container includes first and second door frames that are arranged in opposing relationship, opposing articulating sidewalls extending between the first and second door frames, and opposing sidewalls extending between the first and second door frames that can function as ceiling and floor.

Each door frame includes first and second posts that are arranged in opposing relationship. The first post includes a first hinge and the second post includes a second hinge, the position of the second hinge being flipped relative to the position of the first hinge about an axis transversely bisecting the first and second posts when the container is in an expanded state.

The first hinge segments the first post into comparatively short and long first post portions and the first hinge is configured to enable the long first post portion to fold inwardly. The second hinge segments the second post into comparatively long and short second post portions and the second hinge is configured to enable the second post to fold inwardly The long first post portion includes a first skate disposed at an end thereof, and the long second post portion includes a second skate disposed at an end thereof.

Each door frame includes first and second sills or cross-beams that are arranged in opposing relationship. The first cross-beam has an end thereof fixed to the short second post portion and the second cross-beam has an end thereof fixed to the short first post portion. The first cross-beam receives the first skate and the second cross-beam receives the second skate.

Each door frame includes first and second latches. The first latch inhibits movement of the first skate and the second latch inhibits movement of the second skate.

Each door frame includes a bifold door having a first door half hinged to the first post and a second door half hinged to the second post, each of the first and second door halves being extensible along an axis extending parallel to the first and second posts when the container is in the expanded state.

The opposing sidewalls extending between the first and second door frames are arranged along planes transverse to the first posts and second posts when the container is in the expanded state. These sidewalls can function as the container ceiling and floor.

The opposing articulating sidewalls extending between the first and second door frames are arranged along planes parallel to the first posts and second posts, respectively. One articulating sidewall extends between the first posts of the first and second door frames and is foldable about an elongate joint extending from the first hinge of the first door frame to the first hinge of the second door frame. The other articulating sidewall extends between the second posts of the first and second door frames and is foldable about an elongate joint extending from the second hinge of the first door frame to the second hinge of the second door frame.

To collapse the container (i) the bifold doors of the first and second door frames can be opened, and (ii) the latches of the first and second door frames can be released. This enables the long first post portion in each door frame to travel along the first cross-beam and the second long post portion in each door frame to travel along the second cross-beam so as to incline the long first and second post portions relative to the short first and second post portions, respectively.

The first and second latches can each include a translatable bolt for latching the first and skates, respectively.

Each bolt can translate within its respective post and can be controlled by an external handle. For safety purposes, the external handle can be inaccessible when the corresponding door half is closed. The external handle can also be connected to a lock pin for securing the bolt between an engaged position, in which the bolt interferes with the first skate to prevent the sliding movement thereof, and a disengaged position, in which the bolt does not interfere with the first skate. A toggle mechanism can be connected to the bolt for biasing the bolt between the engaged and disengaged positions.

The skates can be roller skates. The cross-beams can have end portions that are ramped so as to induce the slide of the corresponding skates when the corresponding latches are released. The cross-beams can include tracks that constrain the motion of the roller skates along travel paths.

Each skate can include a first toothed periphery, and the corresponding cross-beam can include a second toothed periphery facing the first toothed periphery when the container is in the expanded state. The skate can be seated on a compressible material disposed on the corresponding cross-beam, which enables the first toothed periphery to engage and interlock with the second toothed periphery when the compressible material is compressed by a predetermined extent.

Each latch can also include a ratchet and pawl set, and the corresponding skate can include a striker that interacts with the ratchet. The ratchet can pivot between a latched position in which the corresponding skate striker is secured and an unlatched position in which the corresponding skate striker is released by the ratchet. The ratchet can be biased towards the latched position and include a release lever for manual release of the corresponding skate striker. The pawl can pivot between a blocking position, in which the pawl blocks pivotal movement of the ratchet towards the latched position in order to maintain the ratchet in a non-latched position, and an un-blocking position, in which the pawl does not prevent pivotal movement of the ratchet toward the latched position.

The pawl can be biased towards the blocking position. Each post can include a pusher that moves the pawl to the un-blocking position when the corresponding long post portion inclines against the corresponding short post portion.

A series of tension latches can be provided for maintaining the container in the collapsed state. Each tension latch can include a tension member and a ratchet and pawl set, wherein the tension member includes a striker than interacts with the ratchet and pawl set to releasably secure the striker.

Each door half can include a hollow central section and fore and aft door inserts glidingly mounted to the central section. The door inserts can be connected to a 3-bar linkage; a rotatable drum can be rotatably connected to the central section and hold a central bar of the 3-bar linkage; and an external handle can be connected to the drum, whereby turning the handle causes the door inserts to slidingly extend out of or retract into the central door section.

The central door section can be opened 180 degrees to lie flat against the corresponding articulating sidewall. To achieve this, the long post portion can include first and second elongate members; the central section can be hinged to the first elongate member; and the first elongate member can be hinged to the second elongate member.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
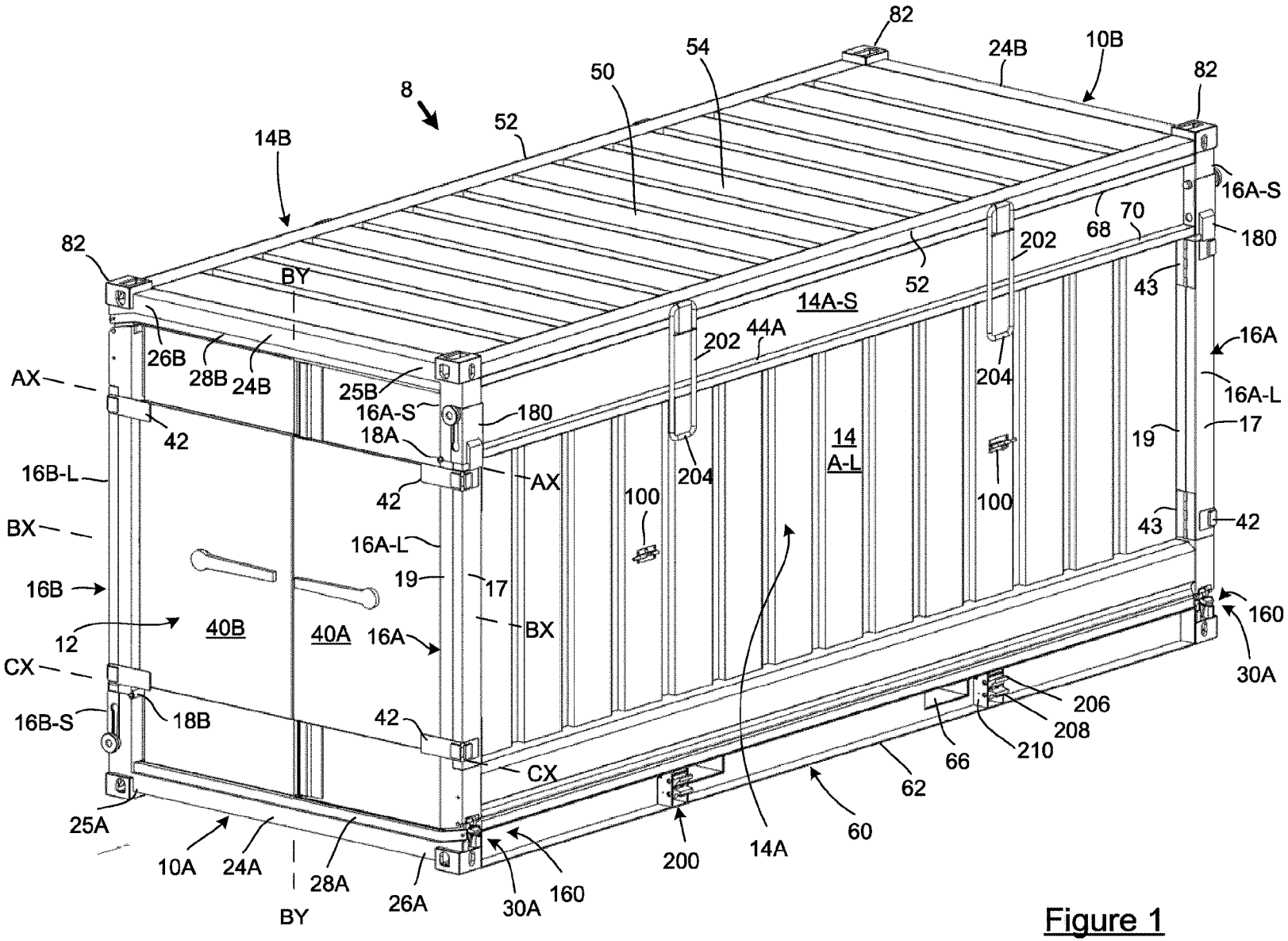
FIG. 1 is a perspective view a collapsible container according to an embodiment of the invention, the container being shown in an expanded state.

For simplicity and clarity of illustration, where considered appropriate, reference numerals may be repeated among the Figures to indicate corresponding or analogous elements. In this disclosure, a numerical drawing reference (e.g., 10, 20, 30) designates a constructional assembly or component, which may or may not incorporate sub-assemblies or sub-components that are themselves designated by additional numerical references. Alphabetical suffixes appended to numerical references (e.g., 10A, 10B, 10C) refer to instantiations of the same assembly or component that may be arranged in the same or different orientations. Unless the context dictates otherwise, reference to a numerical drawing reference without the alphabetical suffix refers to all instances of the assembly or component.

Directional terms such as "up", "down", "front", "rear" etc., are used to inter-relate the positions of parts with reference to the drawings discussed herein; such terms are to be understood in their relative sense and are not intended to limit the disposition of components or parts to the specific embodiments illustrated herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

It will also be noted that the use of the term "a" or "an" will be understood to denote "at least one" in all instances unless explicitly stated otherwise or unless it would be understood to be obvious that it must mean "one".

In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Figure 2:
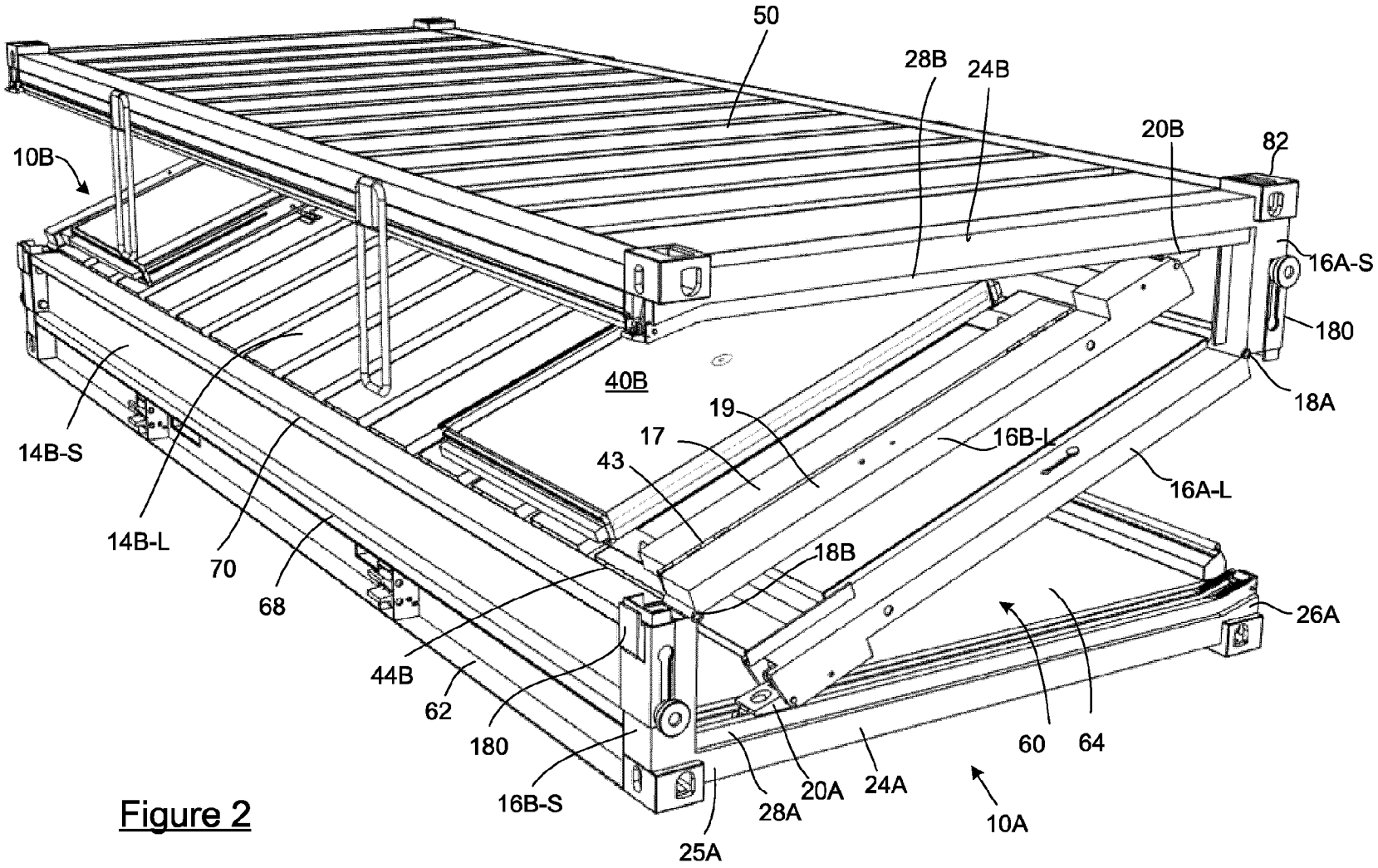
FIG. 2 is a perspective view of the collapsible container, shown in an intermediate state of collapse.
Figure 3:
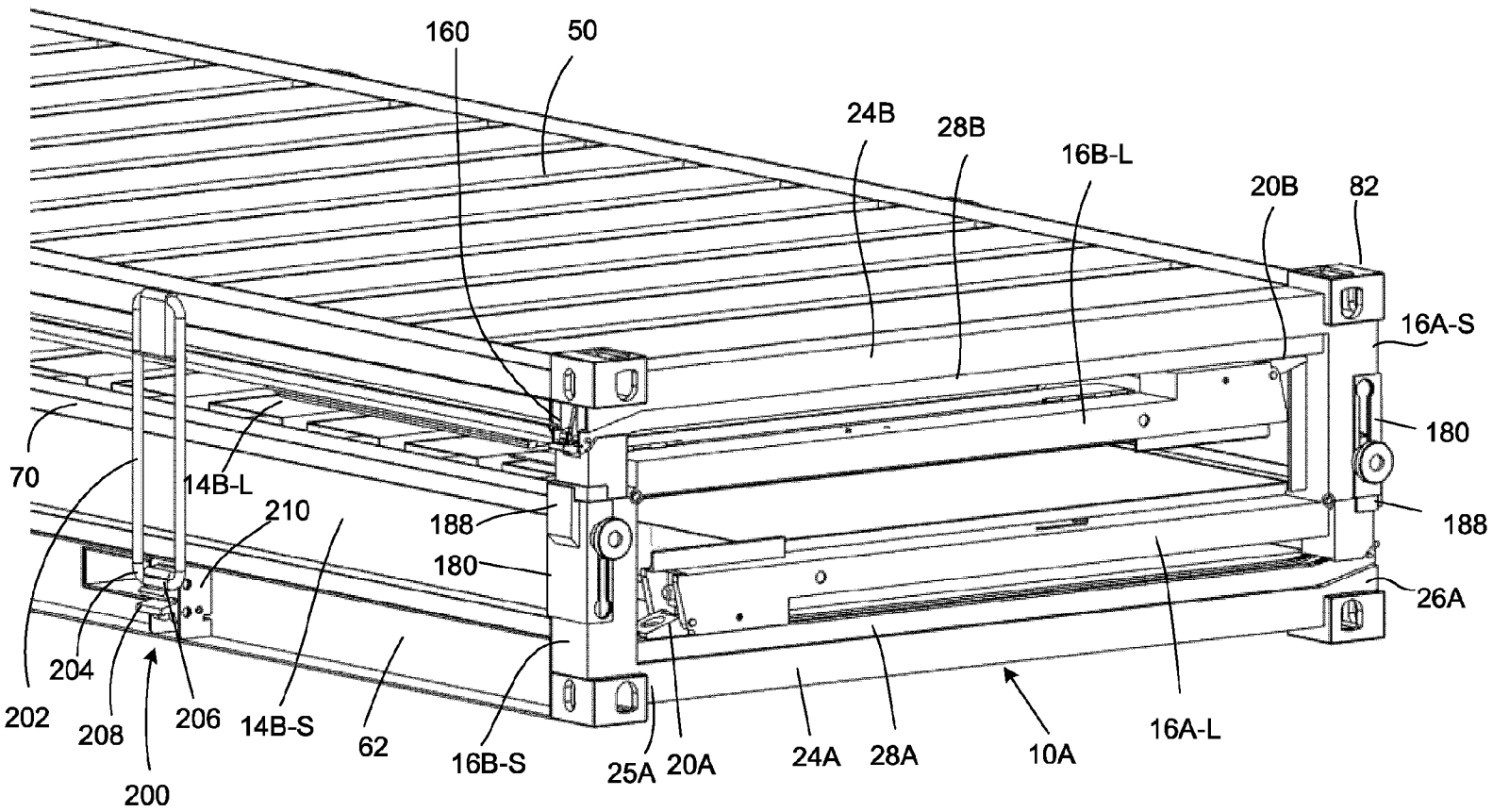
FIG. 3 is a perspective view of the collapsible container, shown in a collapsed state.

FIGS. 1-3 show a collapsible shipping container 8, with FIG. 1 showing the container 8 in its fully expanded state, FIG. 2 showing the container 8 in the process of being collapsed, and FIG. 3 showing the container 8 in its fully collapsed state.

The major structural elements which allow the container 8 to collapse include: two opposing collapsible door frames 10 (individually designated as 10A and 10B); retractable bifold doors 12 that are mounted in each door frame 10, and articulating sidewalls 14 (individually designated as 14A and 14B) that fold when the door frames 10 are collapsed.

The two door frames 10 are disposed in opposing, mirror relationship.

Each door frame 10 includes first and second corner or outermost posts 16A, 16B that are vertically orientated and in opposing relationship when the container 8 is in the expanded state as shown, for example, in FIG. 1. The first post 16A includes a first hinge 18A that allows a portion of the first post 16A to fold inwardly, and the second post 16B includes a second hinge 18B, similar to the first hinge 18A but opposite in orientation, which allows a portion of the second post 16B to fold inwardly. More particularly, the second hinge 18B is positioned such that it is flipped relative to the position of the first hinge 18A about an axis BX-BX transversely bisecting the first and second posts 16A, 16B when the container 8 is in the expanded state. The hinges 18A, 18B are positioned are such that, with respect to the views shown in FIGS. 1-3, the first hinge 18A segments the first post 16A into a comparatively short upper first post portion 16A-S and a comparatively long lower first post portion 16A-L. Similarly, with respect to the views shown in FIGS. 1-3, the second hinge 18B segments the second post 16B into a comparatively long upper second post portion 16B-L and a comparatively short lower second post portion 16B-S. As discussed below, the first and second long post portions 16A-L and 16B-L pivot inwardly to collapse the container 8.

Figure 4:
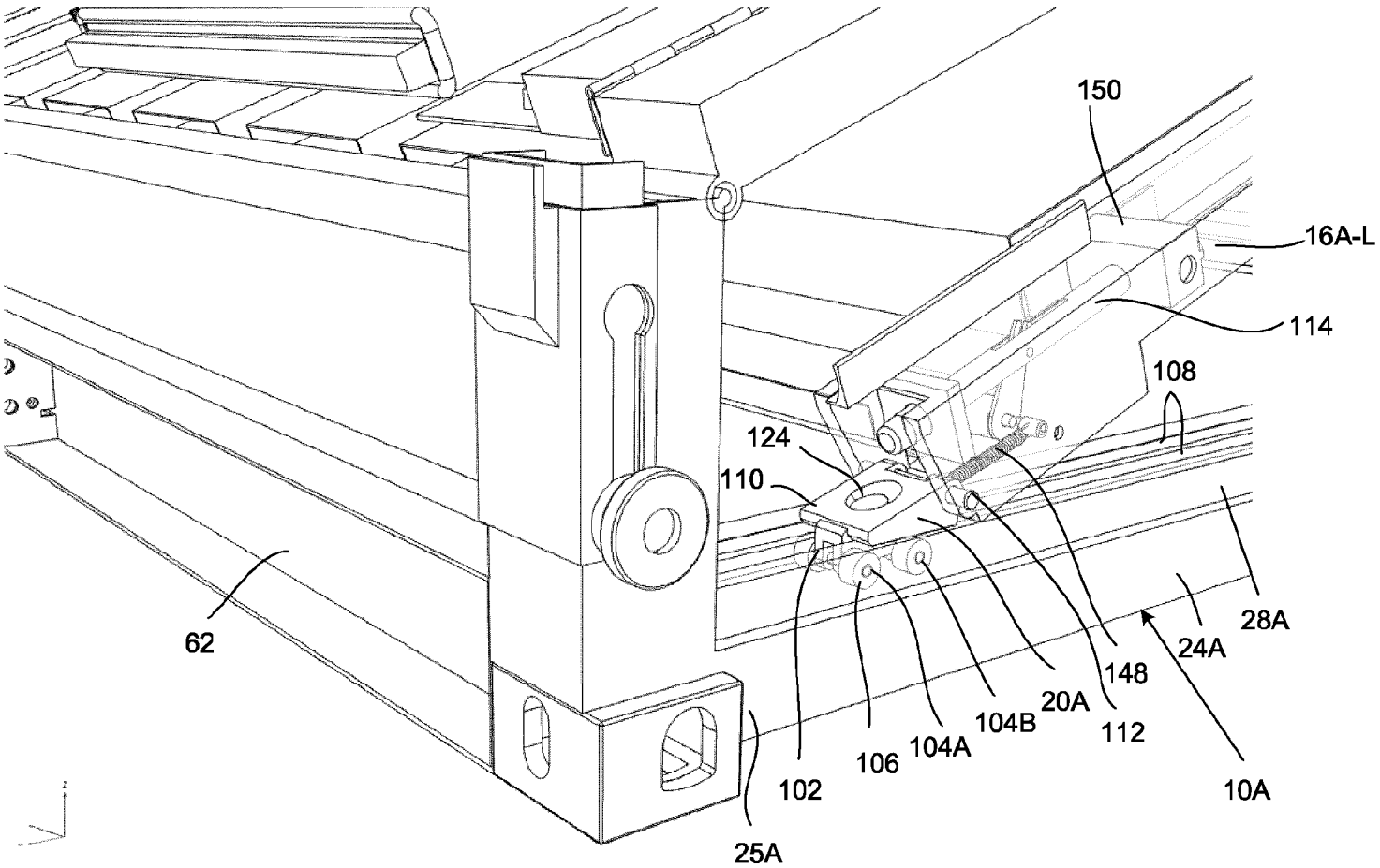
FIG. 4 is a fragmentary, partially transparent, detail view of a corner portion of the container shown in FIG. 3.
Figure 5:
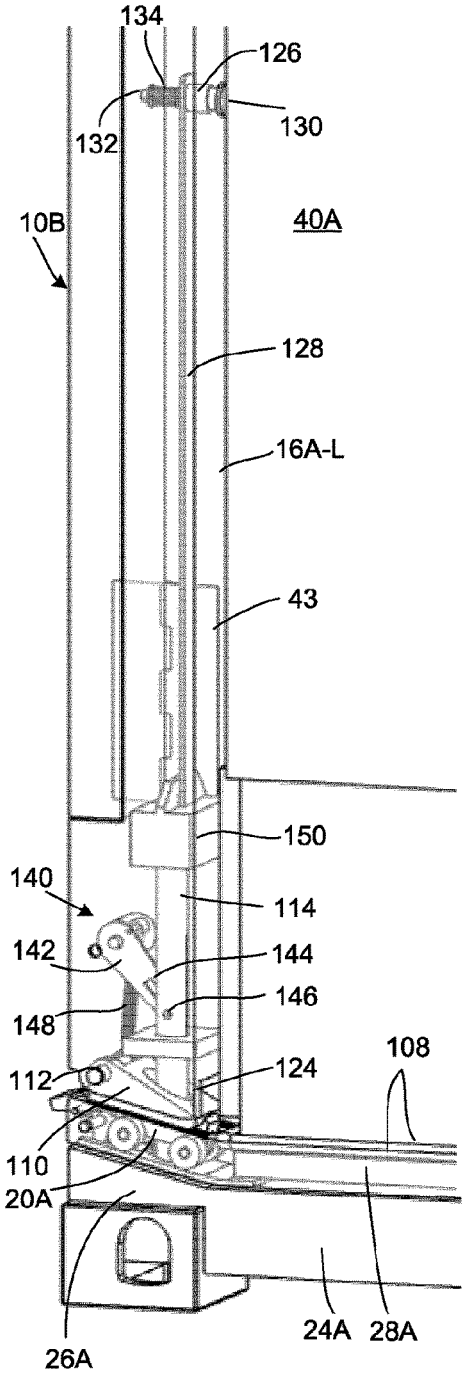
FIG. 5 is a fragmentary, partially transparent, detail view of a post employed in the container shown in FIGS. 1-3, the post being shown in an expanded state.

Referring additionally to the fragmentary views of FIGS. 4 and 5, the long lower first post portion 16A-L includes a first skate 20A disposed at an end thereof and the long upper second post portion 16B-L includes a second skate 20B (seen in FIG. 2) disposed at an end thereof. FIGS. 4 and 5 show skate 20A explicitly. Skate 20*b* is mostly hidden from view in FIGS. 1-3 but other than orientation is preferably constructed the same as skate 20A. Reference to skate 20, generically, will refer to either skate 20A or 20B.

As seen best in FIGS. 1-3 the first and second posts 16A, 16B are inter-connected via first (lower in FIGS. 1-3) and second (upper in FIGS. 1-3) sills or cross-beams 24A, 24B, respectively, that are disposed in opposing relationship. The first cross-beam 24A has one end 25A integral with or otherwise fixed to the short second post portion 16B-S and the second cross-beam 24B has one end 25B integral with or otherwise fixed to the short first post portion 16A-S. As seen best in FIGS. 1 and 5, the first skate 20A of the long lower first post portion 16A-L sits on the other end 26A of the first cross-beam 24A when the container 8 is in its expanded state, and as described below, the first skate 20A rides along a track 28A supported by the first cross-beam 24A as the container 8 transitions between expanded and collapsed states. Similarly, the second skate 20B of the long upper second post portion 16B-L sits on the other end 26B of the second cross-beam 24B when the container 8 is in its expanded state and, as described below, the second skate 20B rides along a track 28B supported by the second cross-beam 24B as the container 8 transitions between expanded and collapsed states.

As described in greater detail below, the first and second skates 20A, 20B are locked and prohibited from movement by first and second locks 30A, 30B, respectively, which assist in maintaining the container 8 in its expanded state.

As seen in FIG. 1, each bifold door 12 has a first door half 40A hinged (via hinges 42) to the first post 16A and a second door half 40B hinged (via hinges 42) to the second post 16B. The hinges 42 are disposed inward of axes AX-AX and CX-CX which extend perpendicular to the first and second posts 16A, 16B along the positions of the first and second post hinges 18A, 18B, respectively. Each of the first and second door halves 40A, 40B is extensible along an axis BY-BY extending parallel to the first and second posts 16A, 16B when the container 8 is in its expanded state.

The articulating sidewalls 14A and 14B are arranged in opposing relationship (left and right in the views of FIGS. 1-3) and extend between the first and second door frames 10A, 10B along planes parallel to the first posts 16A and second posts 16B, respectively. Articulating sidewall 14A extends between the first posts 16A of the first and second door frames 10A, 10B and is foldable about an elongate joint 44A extending between the first hinges 18A of the first and second door frames 10A, 10B. The elongate joint 44A defines short and tall segments 14A-S, 14A-L of the articulating wall 14A. Similarly, as seen best in FIG. 2, the other articulating sidewall 14B extends between the second posts 16B of the first and second door frames 10A, 10B and is foldable about an elongate joint 44B extending between the second hinges 18B of the first and second door frames 10A, 10B. The elongate joint 44B likewise defines tall and short segments 14B-L, 14B-S of the articulating wall 14B.

A pair of opposing (upper and lower in FIGS. 1-3) sidewalls 50, 60 extend between the first and second door frames 10A, 10B along planes transverse to the first posts 16A and second posts 16B (when the container is in its expanded state). These sidewalls 50, 52 are not articulated and, in use, provide a ceiling and floor.

As will be seen from the foregoing, the bifold doors 12 of the door frames 10 can be opened so they do not block the articulation of the first and second posts 16A, 16B. The locks 30 of the door frames 10 can then be released. This enables the skates 20A, 20B of the long first and second post portions 16A-L, 16B-L to travel along the tracks 28A, 28B of the first and second cross-beams 24A, 24B, respectively, in order to initiate the collapse the container 8. In the process, the articulating sidewalls 14A, 14B fold about their elongate joints 44A, 44B, respectively. In the collapsed state the long first and second post portions 16A-L, 16B-L lie at right angles relative to the short first and second post portions 16A-S, 16B-S, respectively, and the articulating wall long segments 14A-L, 14B-L lie at right angles relative to the articulating wall short segments 14A-S, 14B-S, respectively.

With the foregoing overview in mind, additional details of the container are discussed below.

Sidewall 50 functions as the container ceiling in normal use. As seen best in FIG. 1, the sidewall 50 can include opposing side rails 52 fixed to the ends of the second cross-beams 24B of doors frames 10A, 10B. The fixation may be through welds and/or bolts or any other means known in the art. A corrugated panel 54 can be fixed to the frame defined by the top side rails 52 and second cross-beams 24B.

Sidewall 60 functions as the container floor in normal use. The sidewall 60 can include opposing bottom side rails 62, such as provided by an I-beam, fixed to the ends of the first cross-beams 24A. The fixation may be through welds and/or bolts or any other means known in the art. A series of floor joists (not shown) can extend between the bottom side rails 62 for load support and a floor panel 64 (seen best in FIG. 2) can be fixed to the floor joists. The bottom side rails 62 can include slots 66 therein for receiving forklift tines.

Figure 10:
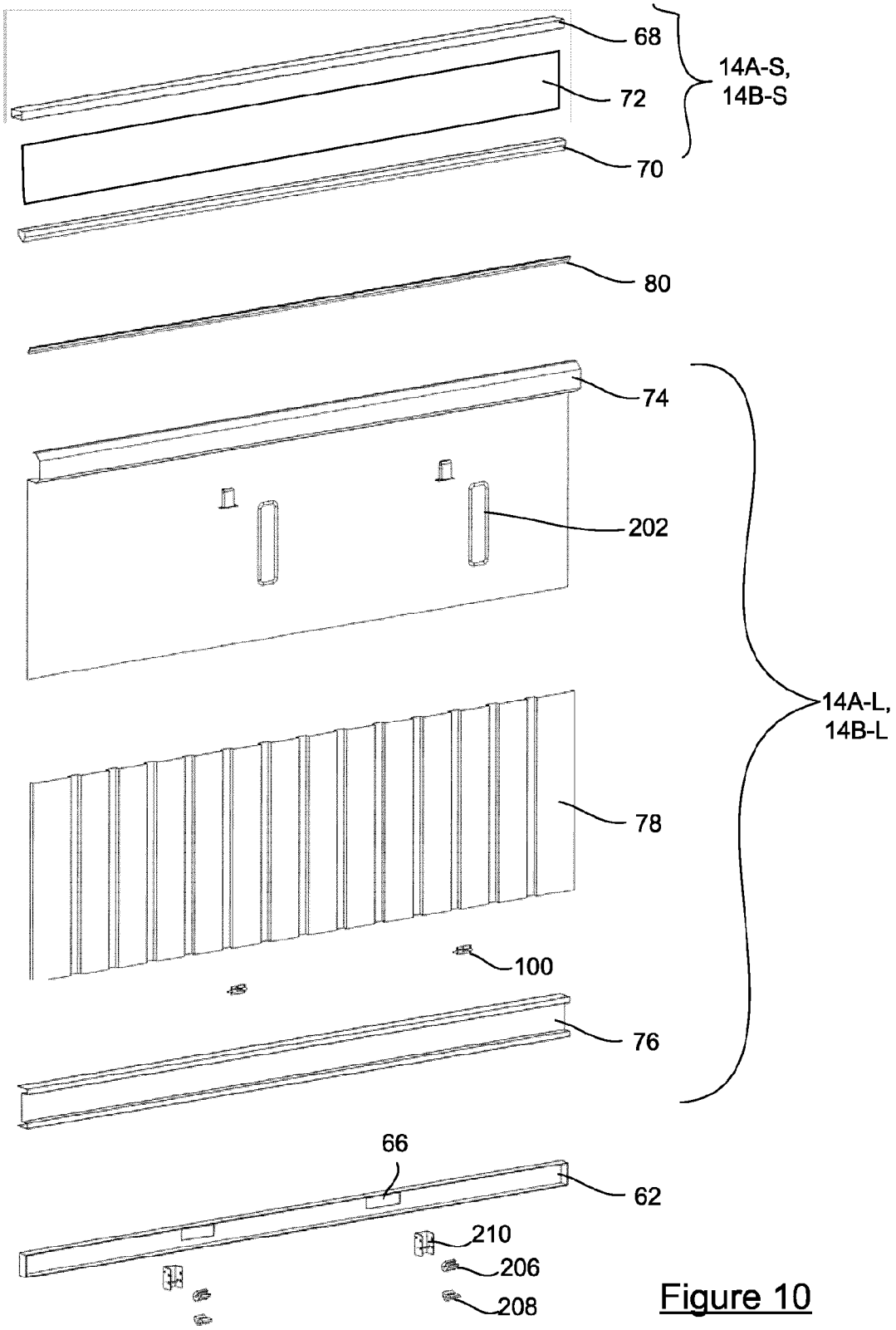
FIG. 10 is an exploded view of the structure of an articulating sidewall employed in the container shown in FIGS. 1-3.

Referring to FIG. 1 and additionally to the exploded view of FIG. 10 the short articulating wall segment 14A-S can be provisioned by a pair of spaced-apart bars 68, 70 that are fixed to the short post portions 16A-S of door frames 10A, 10B along with a panel 72 fixed to the bars 68,70. The short articulating wall segment 14B-S can be constructed likewise. The long articulating wall segment 14A-L can be provisioned by a header beam 74 and a spaced apart footer beam 76, both of which are fixed to the long post portions 16A-L of door frames 10A, 10B, along with a corrugated panel 78 affixed to the beams 74, 76. The long articulating wall segment 14B-L can be constructed likewise. A weather seal 80 can be interposed along the elongate joint 44 which is present between bar 70 and header beam 74.

As seen best in FIG. 1, the ends of the cross-beams 24 preferably also feature standardized engagement structure 82 which allow the container 8 to be stacked and/or handled by container handling trucks, forklifts or cranes, as known in the art per se.

Figure 9:
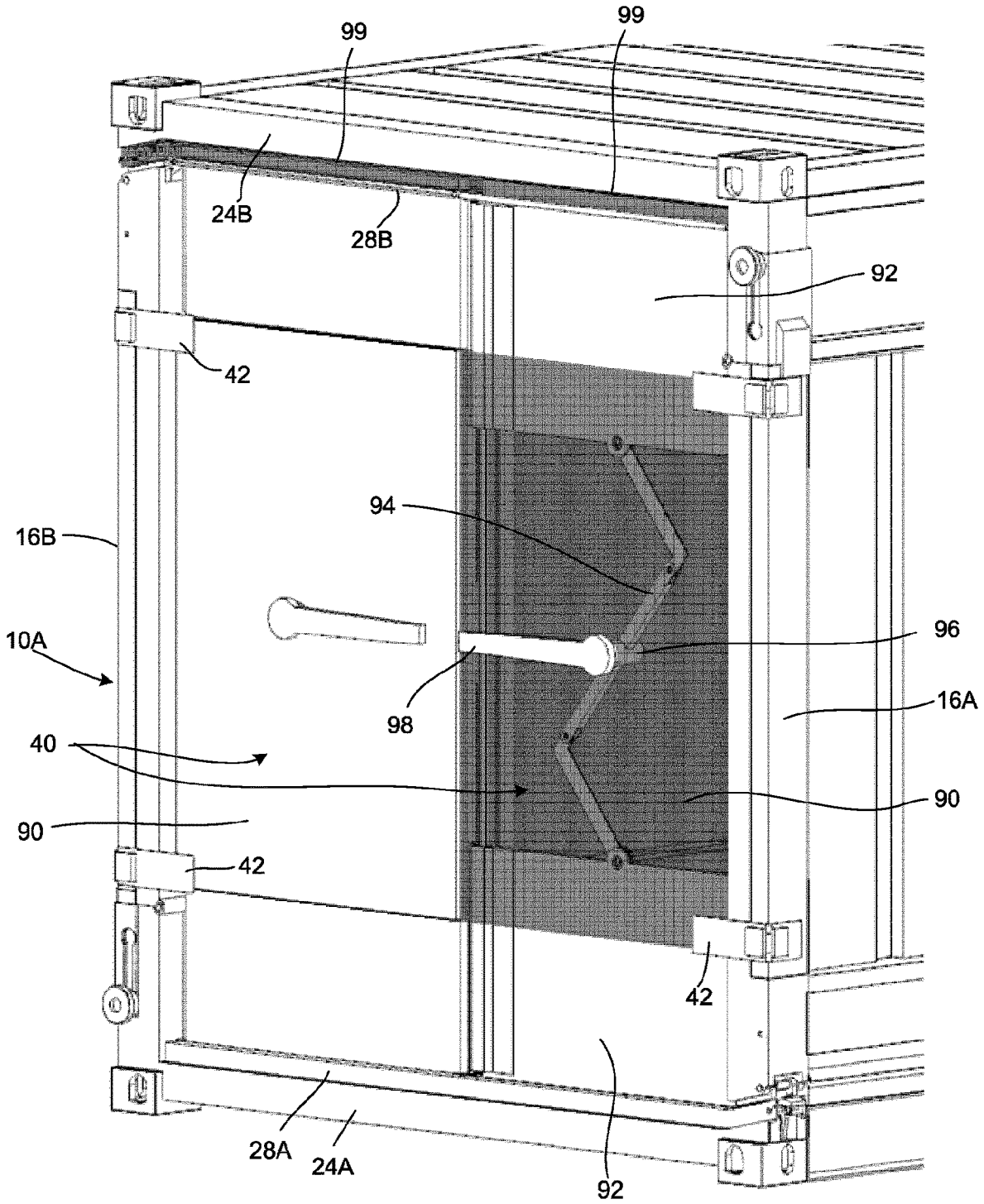
FIG. 9 is a fragmentary, partially transparent, detail view of a sliding door structure employed in the container shown in FIGS. 1-3.

Referring additionally to the fragmentary view of FIG. 9, each bifold door half 40 can include a central section 90 that is hinged to the corresponding door frame 10. The central section 90 can be hollow and function as a sleeve to contain fore and aft door insert sections 92. The door insert sections 92 can be connected to a 3-bar linkage 94. A drum 96 can be rotatably connected to the central section 90 and can hold a central bar of the 3-bar linkage 94. The drum 96 can be controlled by a pivotable external handle 98, whereby pivoting the handle 98 cause the drum 96 to rotate, which causes the door insert sections 92 to slidingly extend out of or retract into the central door section 90.

When fully extended a peripheral edge 99 of each door insert section 92 extends into a corresponding track 28A or 28B. When fully retracted the door insert sections 92 can be sized so as to not jut out of the central section 90.

Bolt latches (not shown) can be deployed between the central 90 and sliding door insert sections 92 to latch the insert door sections 92 in their fully retracted or extended positions.

Figure 8:
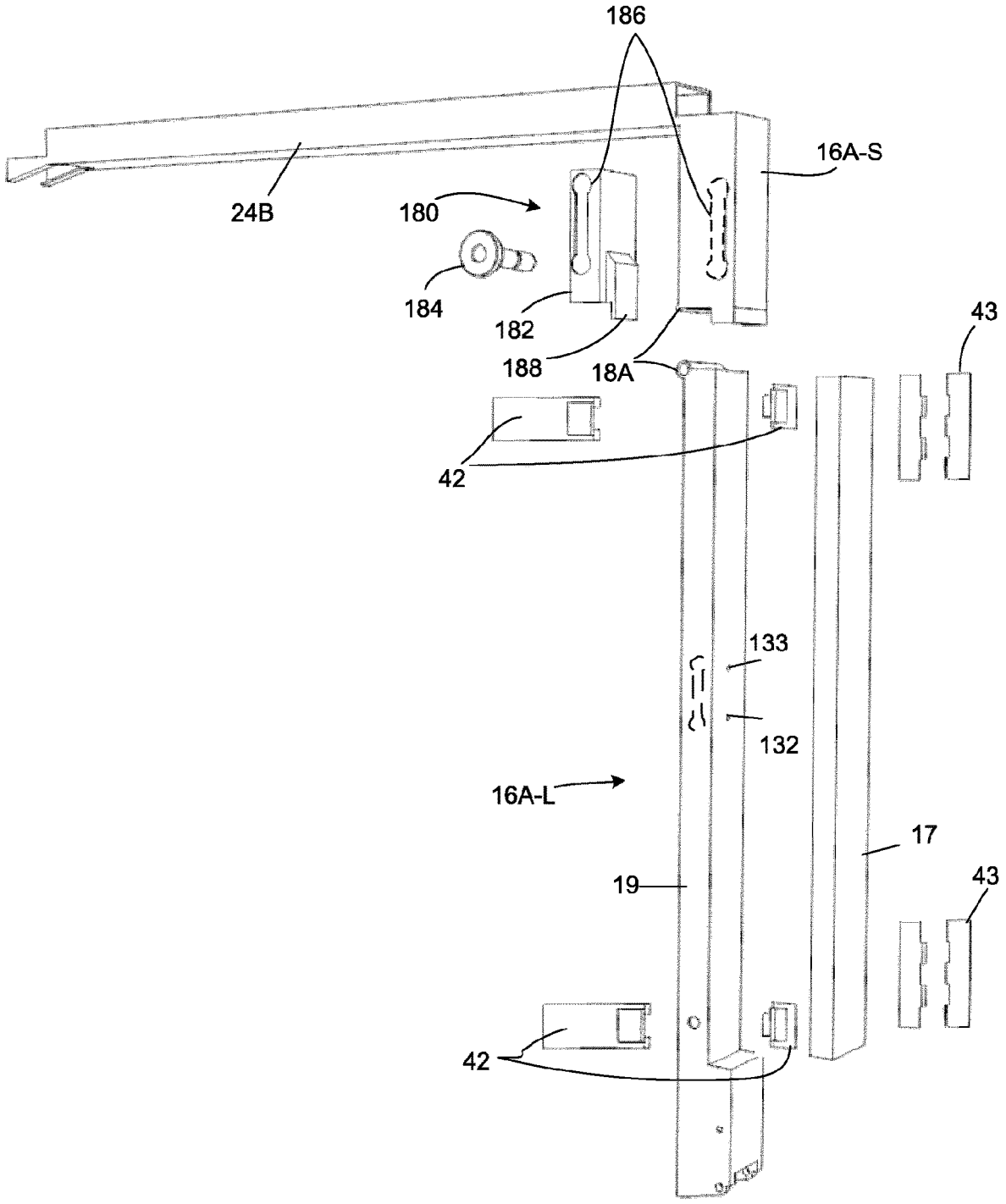
FIG. 8 is an exploded view of another portion of the door frame structure employed in the container shown in FIGS. 1-3.

The bifold door halves 40 can be opened 180 degrees. This can be accomplished by dividing the door swing into two 90 degree swings via two hinges in order to lay the door halves 40 compactly against their respective sidewalls 14. Referring to FIG. 1 and additionally to the exploded view in FIG. 8, it will be seen that the long post portion 16A-L (or 16A-S) is provisioned by first and second elongate parts 17 and 19. Hinges 42 mount the respective door half 40 to the first part 17 of the long post portion. Hinges 43 mount the first part 17 of the long post portion to the second part 19 of the long post portion. When opened 180 degrees, as shown for example in FIG. 2 with respect to door half 40B, the door half lies against the articulating wall long segment (14B-L) and the first part 17 of the long post portion (16B-L) lies against the articulating wall long segment (14B-L).

When the bifold door halves 40 are opened 180 degrees, simple bolt latches 100 disposed on the articulating sidewalls 14 can be deployed to maintain the respective door halves 40 in folded states pinned against the articulating sidewalls 14.

Figure 7:
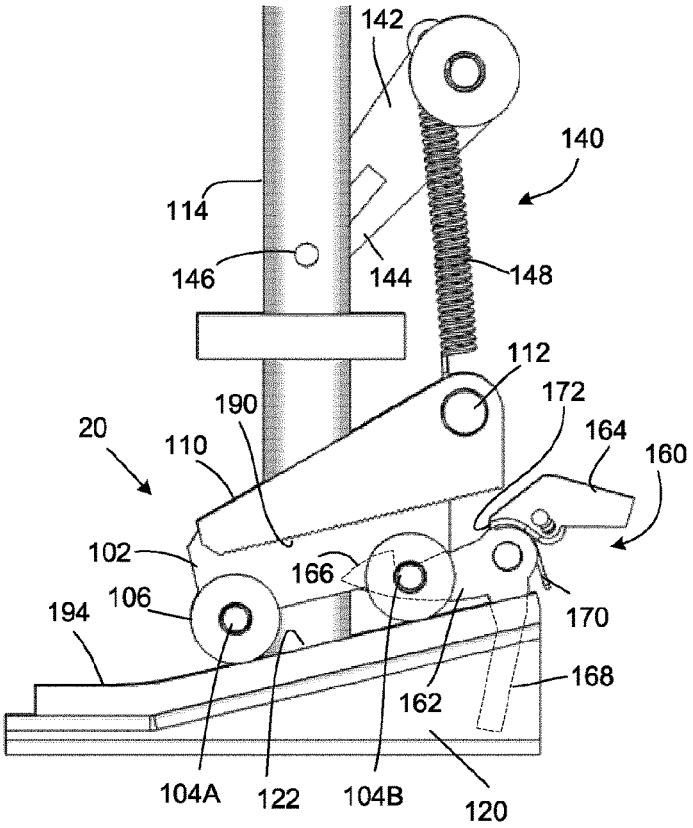
FIG. 7 is a detail plan view of a skate and skate latch mechanism employed in the container shown in FIGS. 1-3.
Figure 6:
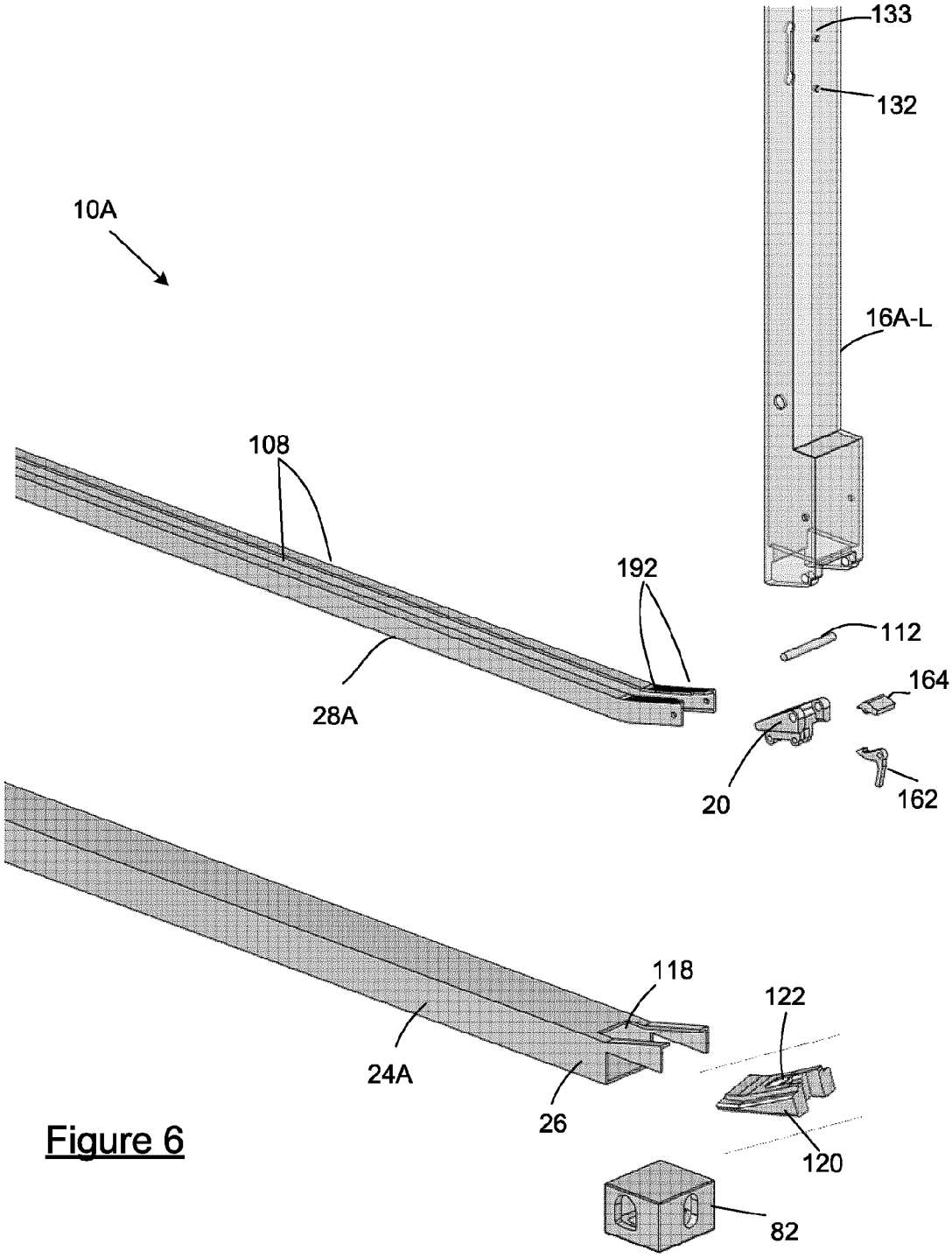
FIG. 6 is an exploded view of a portion of a door frame structure employed in the container shown in FIGS. 1-3.

Referring to FIG. 4 and additionally to FIGS. 5-7 (where FIG. 4 is a fragmentary view, with the post and track in phantom, of the skate when the container is in the process of collapse; FIG. 5 is a fragmentary view, with the post and track in phantom, of the skate 20 and lock 30; FIG. 6 is an exploded view of a corner structure of the container; and FIG. 7 is detail plan view of the skate 20) the skate 20 can have a carriage section 102 which carries fore and aft axles 104A, 104B. Rollers 106 can be rotatably mounted to each axle 104 to enable the skate 20 to roll along the cross-beam 24. The track 28 can be mounted on or otherwise formed with the crossbeam 24 and can be shaped with horizontal ledges 108 (seen best in FIGS. 4 and 6) that prohibit the carriage 102 from lifting off the track 28/crossbeam 24.

The skate 20 can also include a shoe 110 that is disposed over the track ledges 108. The shoe 110 can be fixed to the carriage 102 or alternatively can be detachable therefrom for ease of assembly. The shoe 110 can be hinged to door frame post 16 via a hinge pin 112 that is fitted into corresponding apertures in the shoe 110 and post 16.

The lock 30 can be provisioned via a translatable bolt 114 that locks the skate 20 against the crossbeam 24. More particularly, as seen best in FIG. 6, the crossbeam end 26 can have a rebate 118 therein in which a wedge-shaped fitting 120 can be installed, which is ramped, along with an end portion of the track 28 and the cross-beam 24, in a direction to induce inward slide of the corresponding post 16. The fitting 120 can include an aperture 122, and the skate 20 can include an aperture 124, for passage of the bolt 114.

As seen best in FIG. 5, the bolt 114 can be manipulated by a lock pin 126 which is connected to the bolt 114 via a rod 128. The lock pin 126 can have an external handle or knob 130 which faces against an edge of the door half 40 such that the lock pin 126 cannot be accessed whilst the door half 40 is closed. The lock pin 126 can be fitted in a lock aperture 132 of the post 16 and biased to remain there by a compression spring 134. When the door half 40 is opened the lock pin knob 130 is exposed and can be lifted to move the bolt 114 out of engagement with the fitting 120 and skate 20 and into a disengaged position. In the disengaged position the lock pin 126 can be fitted into an unlock aperture 133 in the post 16 (see FIG. 6) to maintain the bolt 114 in the disengaged position.

A toggle mechanism 140 can be provided to bias the bolt 114 into the engaged or disengaged positions. The toggle mechanism 140 can include a fork 142 that is pivotally mounted to the post 16 and has cam tines 144 that engage a follower member 146 of the bolt 114. A spring 148 can be connected between the fork 142 and the shoe hinge pin 112. The spring 148 can be sized and positioned such that after the bolt 114 has travelled a predetermined distance towards the disengaged position the bias force of the spring 148 provides an additional force to urge the movement of the bolt 114 towards the disengaged position. This eases the task of moving the lock pin 126 into the unlock aperture 133 which is gravitationally higher in post 16A than post 16B. Likewise, after the bolt 114 has travelled a predetermined distance towards the engaged position the bias force of the spring 148 provides an additional force to urge the movement of the bolt 114 towards the engaged position. This will ease the task of moving the lock pin 126 into the lock aperture 132, which is gravitationally higher in post 16B than post 16A. The toggle mechanism also reduces the possibility of an errant movement of the bolt 114 if, for example, the lock pin 126 is not engaged.

A guide block 150 can be connected to the bolt 114 in order to guide it within the post 16.

An additional or alternative latch 160 can be provided to hold and release the skate 20.

Latch 160, seen best in FIGS. 6 and 7, includes a ratchet 162 and a pawl 164, both of which are pivotally connected to the track 28 via hinge pins.

As seen best in FIG. 7, the ratchet 162 includes a hook 166 for capture of the aft skate carriage axle 104B, which functions as a striker, and a release handle 168 for moving the ratchet 162 into a non-latched position(s) from the latched position shown in FIG. 7. A spring 170 connected between the ratchet and pawl provides a bias force (clockwise in FIG. 7) to bias the ratchet 162 to the latched position.

The ratchet 162 features a catch 172 which cooperates with the pawl 164. The pawl 164 pivots between a blocking position, in which the pawl 164 engages the catch 172 to prevent pivotal movement of the ratchet 162 in its bias direction and thus maintain the ratchet 162 in the non-latched position(s), and an un-blocking position, wherein the pawl 164 does not engage the catch 172 to prevent pivotal movement of the ratchet 162 toward the latched position. The pawl 164 is biased by the spring 170 in a direction opposite to the ratchet bias direction (counterclockwise in FIG. 7).

Actuating the latch release handle 168 will pivot the ratchet 162 to a non-latched, release position which releases the aft skate carriage axle 104B from the ratchet hook 166. Once released the ramped fitting 120/cross-beam end 26 can induce the skate 20, and the long post portions 16A-L or 16B-L connected thereto, to slide and initiate collapse of the container.

As seen in FIGS. 1-3, each short post portion 16A-S or 16B-S can include a pusher 180 that serves to reset the respective latch 160 as the container 8 collapses. Referring to the exploded view of FIG. 8, the pusher 180 can include a right-angle piece 182 that can be connected to the short post portion 16A-S (or 16B-S) via a spring-loaded pull pin 184 and slot 186 combination such that the vertical position of the pusher 180 can be easily adjusted or removed entirely. FIG. 3 shows the pusher 180 in a non-active position that provides ready access to the operating levers of the skate latch 160 and it will be understood that the pusher 180 can be set to an active position in which an actuation portion 188 of the pusher 180 moves the pawl 164 (FIG. 7) to the unblocking position after the ratchet 162 has been released.

If desired, to further ensure that the container 8 will not collapse if any heavy external weight is imposed on it, such as will occur when containers are stacked on top of one another, as seen best in FIG. 7, the skate shoe 110 can have a serrated or toothed periphery 190 that faces the ramped portion of the track ledges 108, which, as seen best in FIG. 6, can likewise have a counter-facing serrated or toothed periphery 192. As seen best in FIG. 7, the fitting 120 can include a compressible material 194, e.g., a stiff rubber, selected such that if the posts 16 are loaded beyond a predetermined extent the skate 20 can compress the material 194 so that the skate periphery 190 interlocks with the track periphery 192 to inhibit the long post portions 16A-L or 16B-L from sliding.

Figure 11A:
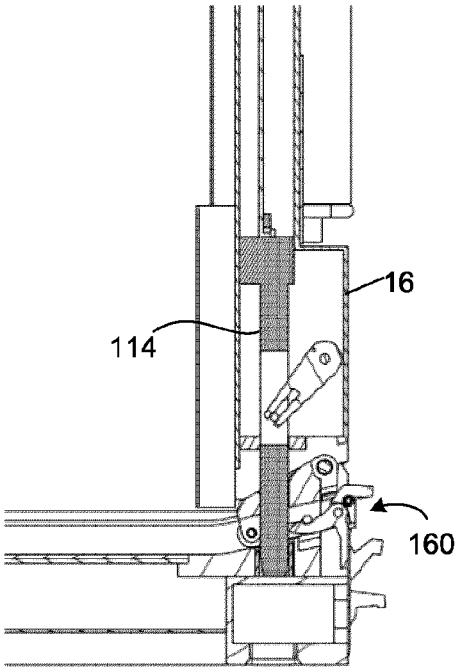
FIG. 11A-11D are cross-sectional views of the skate and skate latch mechanism, in various states of operation.
Figure 11C:
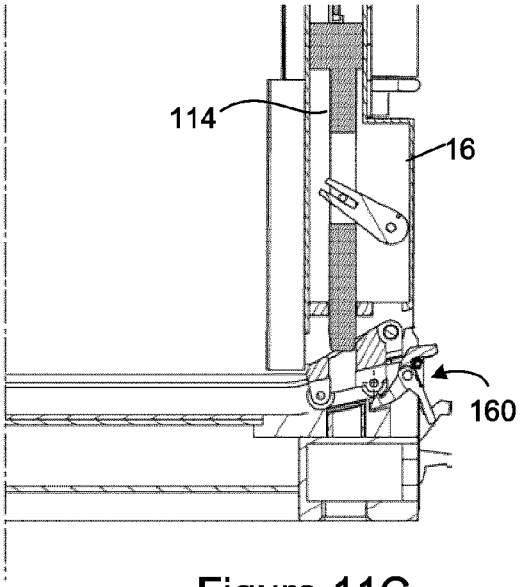
Figure 11B:
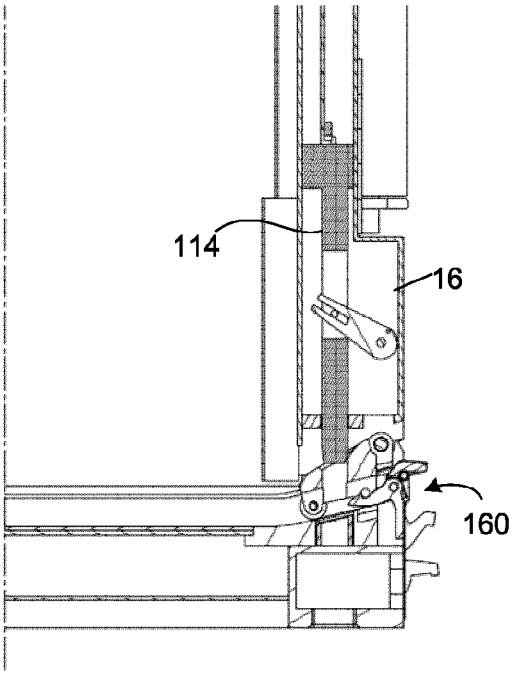
Figure 11D:
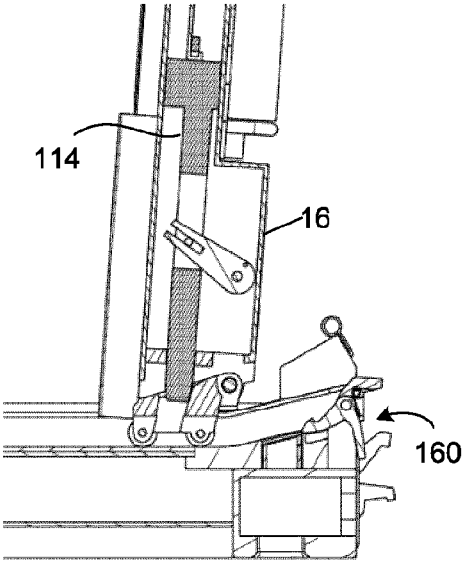
Figure 11E:
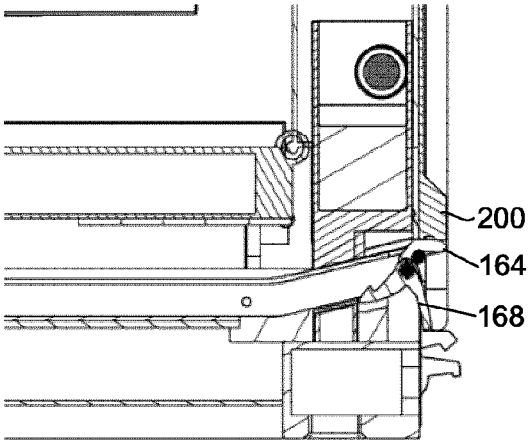
FIGS. 11E-11F are cross-sectional views of the skate latch mechanism, in additional states of operation.
Figure 11G:
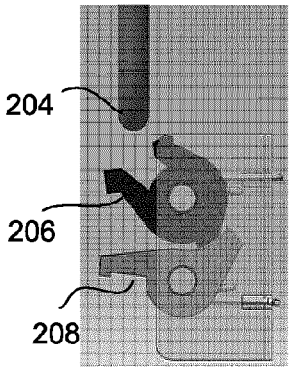
FIGS. 11G and 11H are detail plan views of another latch mechanism for maintaining the container shown in FIGS. 1-3 in the collapsed state.
Figure 11F:
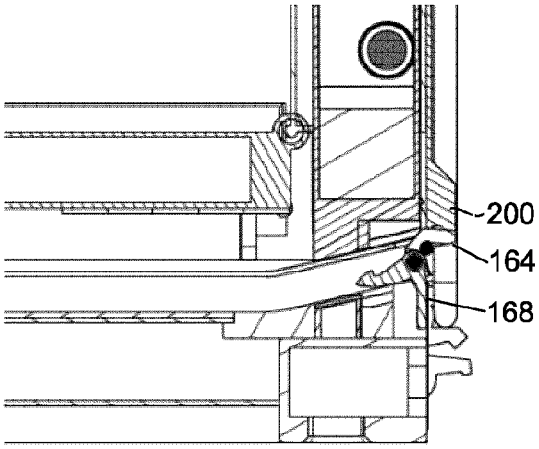
Figure 11H:
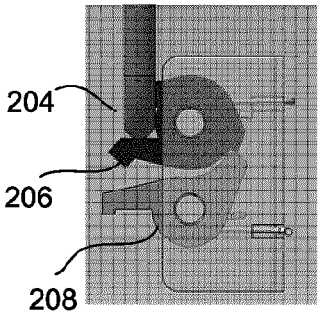

As seen best in FIGS. 1 and 3, the container can also include a plurality of tension latches 200 for maintaining the container 8 in the collapsed state. Each tension latch 200 can include a tension member 202 mounted on the articulating wall short segment 14A-S or 14B-S. A portion of the tension member 202 functions as a striker 204 that engages with a ratchet 206 and pawl 208 set mounted to the bottom side rails 62 via brackets 210. Referring additionally to FIGS. 11G and 11H it will be seen that as the container collapses the striker 204 is captured by the ratchet 206, which is then locked into position by the pawl 208. The pawl 208 may thereafter be manually rotated to release the ratchet 206 and the tension member 202, so as to allow the container to expand.

In operation, commencing from an expanded state and presuming the latch 160 has been reset and the pusher 180 is in the active position, the container can be collapsed as per the following procedure:

First, the door insert sections 92 are retracted into their respective door halves 40.

Next, the door halves 40A, 40B of both door frames 10A, 10B can be opened 180 degrees and pinned against their respective corresponding wall long segments 14A-L or 14B-L, respectively.

Then, the lock pin knobs 130 of all posts 16 can be manipulated to unlatch the respective bolts 114 that lock the respective skates 20. See additionally FIGS. 11A and 11B which show the movement of one bolt 114 from its engaged to disengaged position.

At this point the long post portions 16AL or 16B-L are prevented from sliding inwards solely by the skate latch 160. If desired a lift machine can be employed to lift the container 8 via its roof engagement structures 82, reducing the weight load on the posts 16. The handles 168 of ratchets 162 can be manually employed to unlatch each skate 20. Referring additionally to FIGS. 11C and 11D which show the movement of one skate 20 from latched to unlatched positions, once this is done, the long post portions 16A-L, 16B-L will naturally slide inwardly along the ramped portions of the fittings 120 and cross-beams 28. However, the container 8 will not fully collapse at this point as the container is held off the ground by its roof engagement structures 82. The lift machine can then be employed to collapse the container by bringing the container to the ground, where the inherent weight of the container and/or the downward push of the lift machine induces the container to collapse until the long first and second post portions 16A-L, 16B-L lie at right angles relative to the short first and second post portions 16A-S, 16B-S, respectively, and the articulating wall long segments 14A-L, 14B-L lie at right angles relative to the articulating wall short segments 14A-S, 14B-S, respectively.

In the process, referring additionally to FIGS. 11E-11H, the pushers 180 reset the respective latches 160 as described above, and the tension members 202 are latched by the respective ratchet and pawl 206, 208 sets.

To expand the container, the pushers 180 are moved to their non-active positions and the pawls 208 can be manually rotated to release the ratchets 206 and the tension members 202. The lift machine may thereafter lift the container off the ground via the roof engagement structure 82. The inherent weight of the container will cause the skates 20 and long post portions 16A-L, 16B-L to slide back to their original (vertical) positions. In the process the inherent momentum will cause the aft skate carriage axles 104B to ride over or depress a forward portion of the hooks 166 and be captured therein. With the long post portions 16A-L, 16B-L in a vertical position the respective lock pin knobs 130 can be manipulated to drive the respective bolts 114 to their engaged positions to lock the respective skates 20.

It should be appreciated from the foregoing that the process of collapsing or expanding the container does not place personnel at any risk of harm as whenever any manual activity is required the container is in a secured position. It should also be appreciated that all manual activity occurs from outside the container—there is no need to go inside the container to activate any operating mechanisms.

Persons skilled in the art will appreciate that a variety of modifications may be made to the embodiment disclosed herein. For example, the skate 20 has been shown to be a roller-style skate, however a sliding skate may be employed in the alternative. Likewise, the fittings can be omitted, and the structure integrally formed with the cross-beams. Or, the ramped fittings or ramped end portions of the cross-beams can be omitted. Also, while the container has been shown with certain latches to lock the skate in place, these latches may be modified or substituted for other forms of latches or locks. For example, the latch bolt may be applied in a different form and/or the toggle mechanism to bias the latch bolt may be omitted. The skate latch can also be omitted or substituted with other forms, for example, a simple hook may be employed to hold the skate as opposed to a ratchet and pawl set. Many modifications may also be made to the load structure; for example, the articulating sidewalls can be formed from fewer pieces. As another example, the long portions of the posts 16 can be made from one piece as opposed to utilizing the two hinged parts 17 and 19.

It should also be appreciated that while the embodiment discussed herein has employed similar structure for the top and bottom portions of each end frame, or the right and left articulating sidewalls, this is not necessary. For example, while the bottom cross-beam 24A has a ramped end portion, the ramped end portion of the top cross-beam 24B can be omitted in practice.

Persons skilled in the art will appreciate that there are yet more alternative implementations and modifications possible, and that the above examples are only illustrations of one or more implementations. The scope, therefore, is only to be limited by the claims appended hereto and any amendments made thereto.

What is claimed is:

1. A collapsible shipping container, comprising:

first and second door frames in opposing relationship, wherein each door frame includes:

first and second posts in opposing relationship, wherein the first post includes a first hinge and the second post includes a second hinge, the position of the second hinge being flipped relative to the position of the first hinge about an axis transversely bisecting the first and second posts when the container is in an expanded state, wherein the first hinge segments the first post into comparatively short and long first post portions and is configured to enable the first long post portion to fold inwardly, and the second hinge segments the second post into comparatively long and short second post portions and is configured to enable the second long post portion to fold inwardly;

wherein the long first post portion includes a first skate disposed at an end thereof, and the long second post portion includes a second skate disposed at an end thereof;

first and second cross-beams in opposing relationship, the first cross-beam having an end thereof fixed to the short second post portion and the second cross-beam having an end thereof fixed to the short first post portion, wherein the first cross-beam receives the first skate and the second cross-beam receives the second skate;

first and second latches, the first latch selectively inhibiting movement of the first skate and the second latch selectively inhibiting movement of the second skate; and a bifold door having a first door half hinged to the first post and a second door half hinged to the second post, each of the first and second door halves being extensible along an axis extending parallel to the first and second posts when the container is in the expanded state;

first and second opposing articulating sidewalls, wherein the first articulating sidewall extends between the first posts of the first and second door frames and is foldable about an elongate joint extending from the first hinge of the first door frame to the first hinge of the second door frame, and the second articulating sidewall extends between the second posts of the first and second door frames and is foldable about an elongate joint extending from the second hinge of the first door frame to the second hinge of the second door frame;

opposing sidewalls extending between the first and second door frames along planes transverse to the first posts and second posts when the container is in the expanded state; and wherein, when (i) the bifold doors of the first and second door frames are opened and (ii) the first and second latches of the first and second door frames are released, in each door frame the long first post portion is enabled to travel along the first cross-beam and the second long post portion is enabled to travel along the second cross-beam so as to incline the long first and second post portions relative to the short first and second post portions, respectively, in order to collapse the container.

2. A container according to claim 1, wherein the first latch includes a translatable bolt for latching the first skate.

3. A container according to claim 2, wherein the bolt translates within the first post and is controlled by an external handle, and wherein the external handle is inaccessible when the first door half is closed.

4. A container according to claim 3, wherein the external handle is connected to a lock pin for securing the bolt between an engaged position, in which the bolt interferes with the first skate to prevent the sliding movement thereof, and a disengaged position, in which the bolt does not interfere with the first skate.

5. A container according to claim 4, including a toggle mechanism connected to the bolt for biasing the bolt between the engaged and disengaged positions.

6. A container according to claim 1, wherein the first skate is a roller skate.

7. A container according to claim 6, wherein an end portion of the first cross-beam is ramped so as to induce the slide of the first skate when the first latch is released.

8. A container according to claim 7, wherein the first cross-beam includes a first track constraining the motion of the first roller skate along a travel path.

9. A container according to claim 7, wherein the first skate includes a first toothed periphery, the first cross-beam includes a second toothed periphery facing the first toothed periphery when the container is in the expanded state, and when the container is in the expanded state the first skate is seated on a compressible material disposed on the first cross-beam, which enables the first toothed periphery to engage and interlock with the second toothed periphery when the compressible material is compressed by a predetermined extent.

10. A container according to claim 1, including a ratchet and pawl set, wherein the first skate includes a striker that interacts with the ratchet.

11. A container according to claim 10, wherein:

the ratchet pivots between a latched position in which the first skate striker is secured and an unlatched position in which the first skate striker is released by the ratchet, the ratchet being biased towards the latched position and including a release lever for manual release of the first skate striker; and the pawl pivots between a blocking position, in which the pawl blocks pivotal movement of the ratchet towards the latched position in order to maintain the ratchet in a non-latched position, and an un-blocking position, in which the pawl does not prevent pivotal movement of the ratchet toward the latched position, the pawl being biased towards the blocking position.

12. A container according to claim 11, wherein the first post includes a pusher that moves the pawl to the unblocking position when the long first post portion inclines against the short first post portion.

13. A container according to claim 1, including a tension latch for maintaining the container in the collapsed state.

14. A container according to claim 13, wherein the tension latch includes a tension member and a ratchet and pawl set, wherein the tension member includes a striker than interacts with the ratchet and pawl set to releasably secure the striker.

15. A container according to claim 1, wherein the first door half comprises a hollow central section and fore and aft door inserts glidingly mounted to the central section.

16. A container according to claim 15, wherein:

the door inserts are connected to a 3-bar linkage;

a rotatable drum is rotatably connected to the central section and holds a central bar of the 3-bar linkage;

an external handle is connected to the drum;

whereby turning the handle causes the door inserts to slidingly extend out of or retract into the central door section.

17. A container according to claim 15, wherein the central section can be opened 180 degrees to lie flat against one of the articulating sidewalls.

18. A container according to claim 17, wherein:

the long first post portion includes first and second elongate members;

the central section is hinged to the first elongate member; and the first elongate member is hinged to the second elongate member.

* * * * *